United States Patent [19]

Stout

[11] Patent Number: 5,067,609

[45] Date of Patent: Nov. 26, 1991

[54] PACKAGING AND DISPLAY CASE FOR DISSIMILAR OBJECTS

[75] Inventor: James T. Stout, Acworth, Ga.

[73] Assignee: The Mead Corporation, Dayton, Ohio

[21] Appl. No.: 591,291

[22] Filed: Oct. 1, 1990

[51] Int. Cl.[5] ..... B65D 5/50

[52] U.S. Cl. ..... 206/45.11; 206/45.14; 206/45.34

[58] Field of Search ..... 206/45.34, 45.31, 45.14, 206/45.11, 45.19, 44 R, 526; 229/162

[56] References Cited

U.S. PATENT DOCUMENTS

| | | | |
|---|---|---|---|
| 312,421 | 2/1885 | Bauer | 206/45.31 |
| 1,167,847 | 1/1916 | Schoettle | 206/45.31 |
| 1,670,498 | 5/1928 | Einson | 229/162 X |
| 2,024,809 | 12/1935 | Schell | 206/45.31 |
| 2,339,555 | 1/1944 | Glass | 206/45.31 |
| 2,711,819 | 6/1955 | Vander Lugt, Jr. | 206/45.31 X |
| 2,744,622 | 5/1956 | Sparks | 206/45.31 |
| 2,921,673 | 1/1960 | Ryan | 206/45.31 |
| 3,168,952 | 2/1965 | Palmer | 206/45.34 |
| 4,501,359 | 2/1985 | Yoshizawa | 206/45.34 X |
| 4,739,353 | 4/1988 | Heuer et al | 206/45.31 X |

*Primary Examiner*—Paul T. Sewell
*Assistant Examiner*—Jacob K. Ackun, Jr.
*Attorney, Agent, or Firm*—Rodgers & Rodgers

[57] ABSTRACT

For packaging, transporting and displaying a plurality of dissimilar objects in a case formed of paperboard and including an outer sleeve together with an inner sleeve telescopically inserted into said outer sleeve, the inner sleeve defining compartments which are vertically disposed and which are spaced apart so as to define a medial vertically disposed cavity therebetween for receiving a main object, the spaced compartments formed within the inner sleeve being arranged to receive a plurality of objects which are dissimilar to the main object and coincidental viewing windows are formed in the front wall of the outer sleeve and in the front panels of the compartment whereby an unobstructed view of the actual object is afforded.

11 Claims, 4 Drawing Sheets

PACKAGING AND DISPLAY CASE FOR DISSIMILAR OBJECTS

TECHNICAL FIELD

This invention relates to the packaging, transporting and displaying of dissimilar objects in a manner to afford mechanically strong protection for the objects as well as an unobstructed view of the different objects.

BACKGROUND ART

While packaging arrangements are known in which objects of different sizes and of different characteristics are known, such arrangements may not afford mechanically strong support and protection for the packaged objects or do not afford an unobstructed view of the objects.

SUMMARY OF THE INVENTION

According to this invention in one form a case for packaging, transporting and displaying a plurality of dissimilar objects includes an outer sleeve having front, back and side walls interconnected to form a tubular structure and including top and bottom closure elements, viewing elements formed in said front wall, an inner sleeve having back and side walls arranged for telescopic insertion into said outer sleeve, a pair of spaced apart compartments formed within said inner sleeve and arranged respectively adjacent said side walls of said outer sleeve and defining a vertical medial cavity therebetween together with viewing windows formed in said compartment and arranged in general coincidence with viewing windows formed in said outer sleeve.

BEST MODE OF CARRYING OUT THE INVENTION

Figure 1:
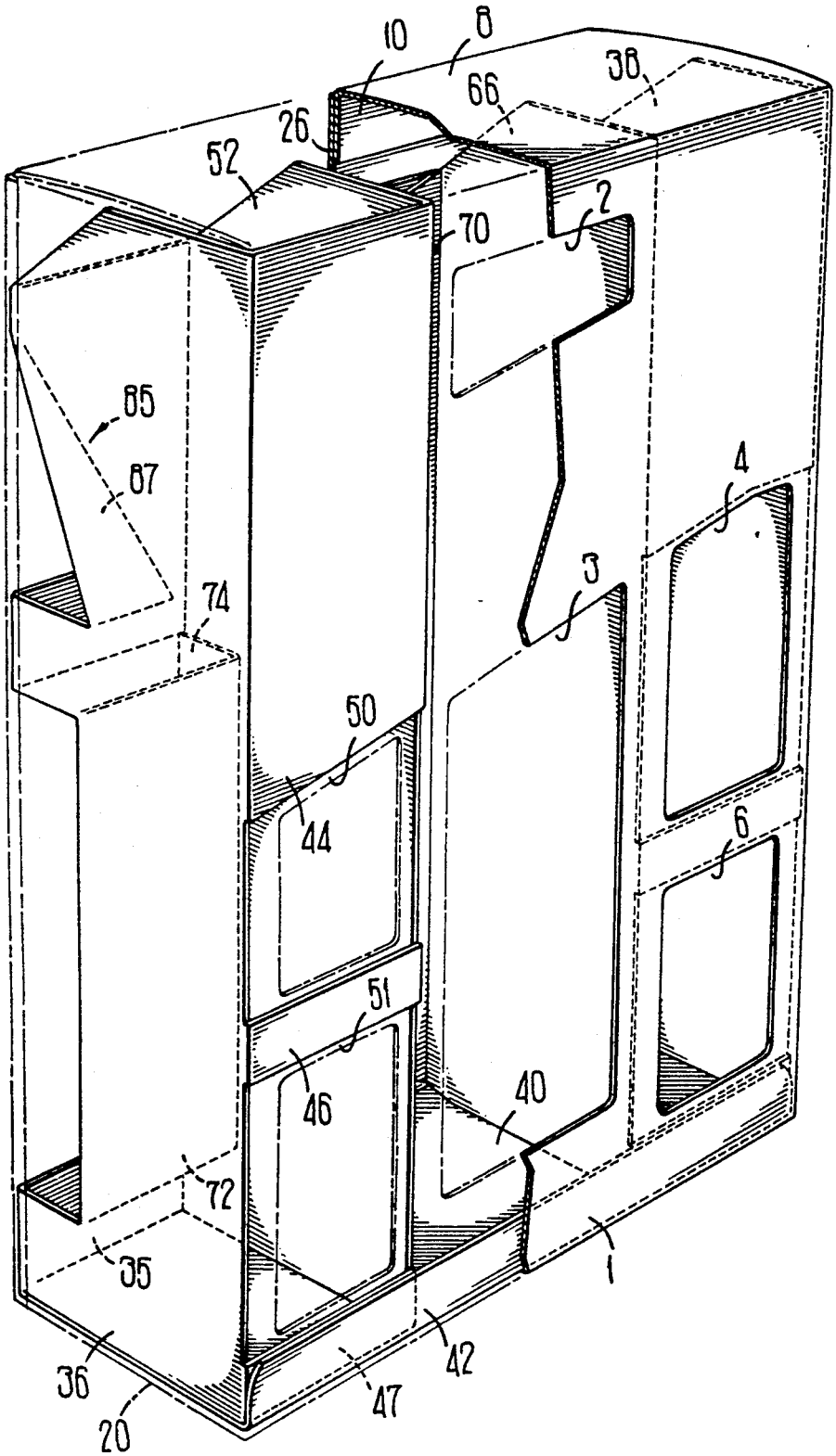
FIG. 1 is a perspective view of an assembled case with certain parts broken away for clarity.

The outer sleeve blank as shown from the inside includes front wall 1 in which medial viewing windows

2 and 3 are formed as well as side viewing windows 4, 5, 6 and 7. Top closure panel 8 is foldably joined to front wall 1 along fold line 9 and a tucking flap 10 is foldably joined to top closure panel 8 along fold line 11. Bottom closure flap 12 is foldably joined to the bottom edge of front wall 1 along fold line 13.

Side wall 14 is foldably joined to an edge of front wall 1 along fold line 15. Top closure flap 16 is foldably joined to side wall 14 along a fold line 17 and bottom closure flap 18 is foldably joined to side wall 14 along fold line 19.

On the other side of the blank side wall 20 is foldably joined to front wall 1 along fold line 21 and top closure flap 22 is foldably joined to the end edge of side wall 20 along fold line 23. Bottom closure flap 24 is foldably joined to side wall 20 along fold line 25.

Back wall 26 is foldably joined to side wall 14 along fold line 27. Bottom closure flap 28 is foldably joined to back wall 26 along fold line 29. Glue flap 30 is foldably joined to back wall 26 along fold line 31.

Figure 2:
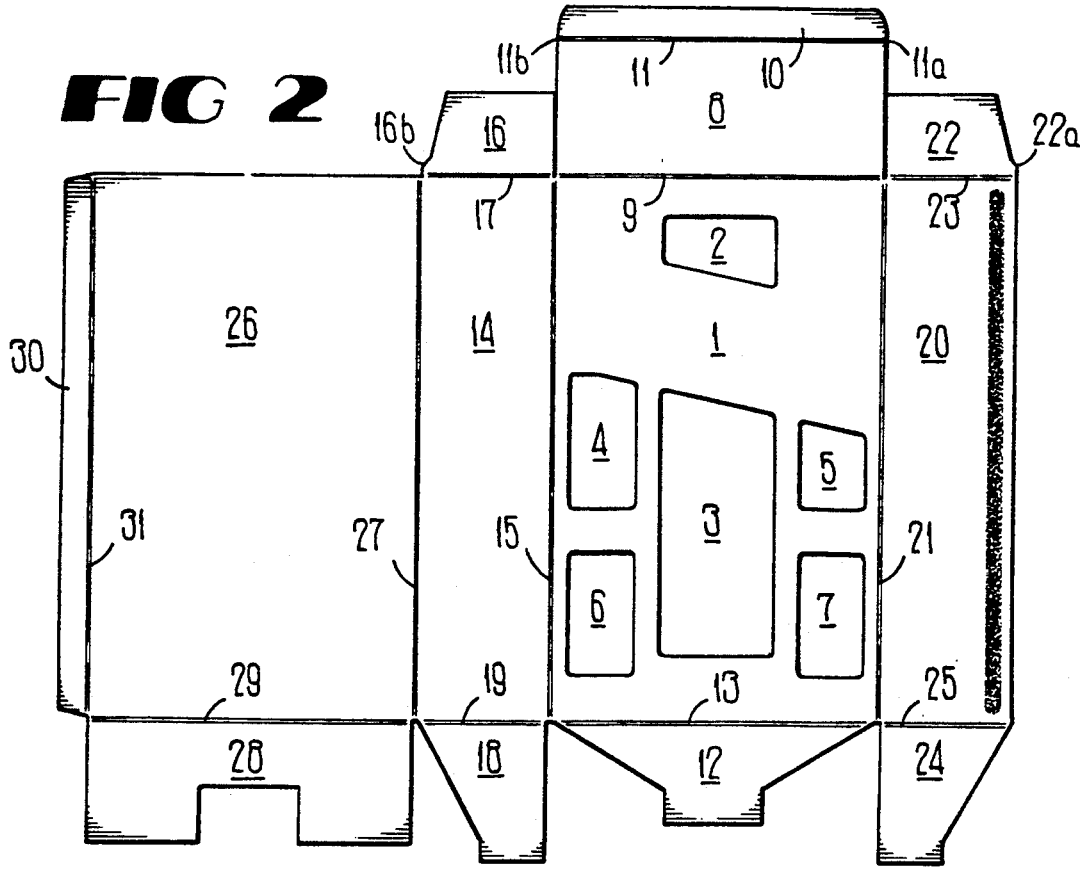
FIG. 2 is a plan view of the inside of a blank from which the outer sleeve is formed.
Figure 3:
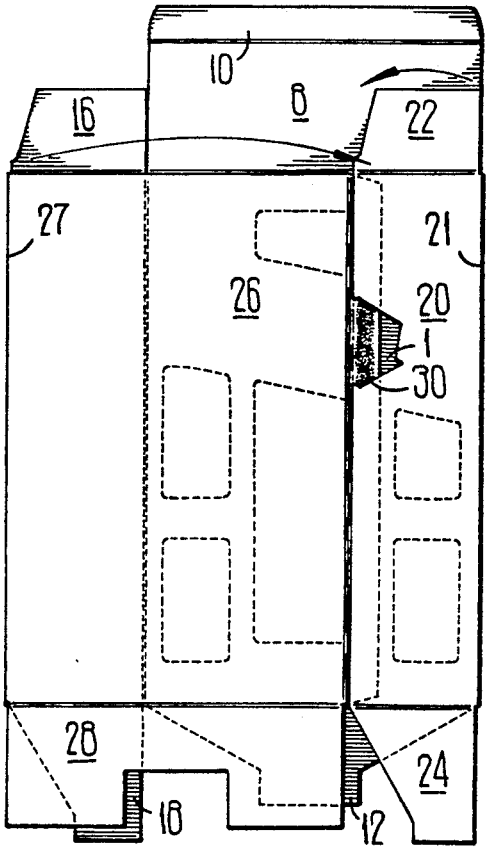
FIG. 3 is a view of the outer sleeve following its folding and glueing operations whereby the outer sleeve is shown in collapsed condition)

In order to manipulate the blank as shown in FIG. 2 into collapsed condition as shown in FIG. 3, an application of glue is applied to an edge of side wall 20 as indicated by stippling in FIG. 2. Thereafter back wall 26 is elevated and folded toward the right along fold line 27. Side wall 20 is then elevated and folded to the left along fold line 21. This operation causes the side wall 20 to adhere to the glue flap 30 by virtue of the glue represented by stippling on side wall 20. The collapsed structure then appears as shown in FIG. 3. When the collapsed outer sleeve as shown in FIG. 3 is manipulated into set up condition for receiving the inner sleeve the outer sleeve appears as best shown in the lower part of FIG. 7. The inner sleeve formed from the blank shown in FIG. 4 as viewed from the inside includes a back wall 35 a side wall 36 foldably joined to back wall 35 along interrupted fold line 37. Side wall 38 is foldably joined to back wall 35 along interrupted fold line 39. Reinforcing bottom panel 40 is foldably joined to the bottom edge of back wall 35 along the fold line 41. Tucking flap 42 is foldably joined to reinforcing bottom panel 40 along fold line 43.

A side compartment includes front panel 44 which is foldably joined to side wall 36 along fold line 45 and a pair of strips 46 and 47 are foldably joined to side wall 36 along fold lines 48 and 49 respectively. Viewing windows 50 and 51 are formed in this compartment.

An inner wall of the side compartment is designated by the numeral 52 and is foldably joined along fold lines 53, 54 and 55 to the top structure of the left compartment. A glue flap 56 is foldably joined to wall 52 along fold line 57.

Figure 4:
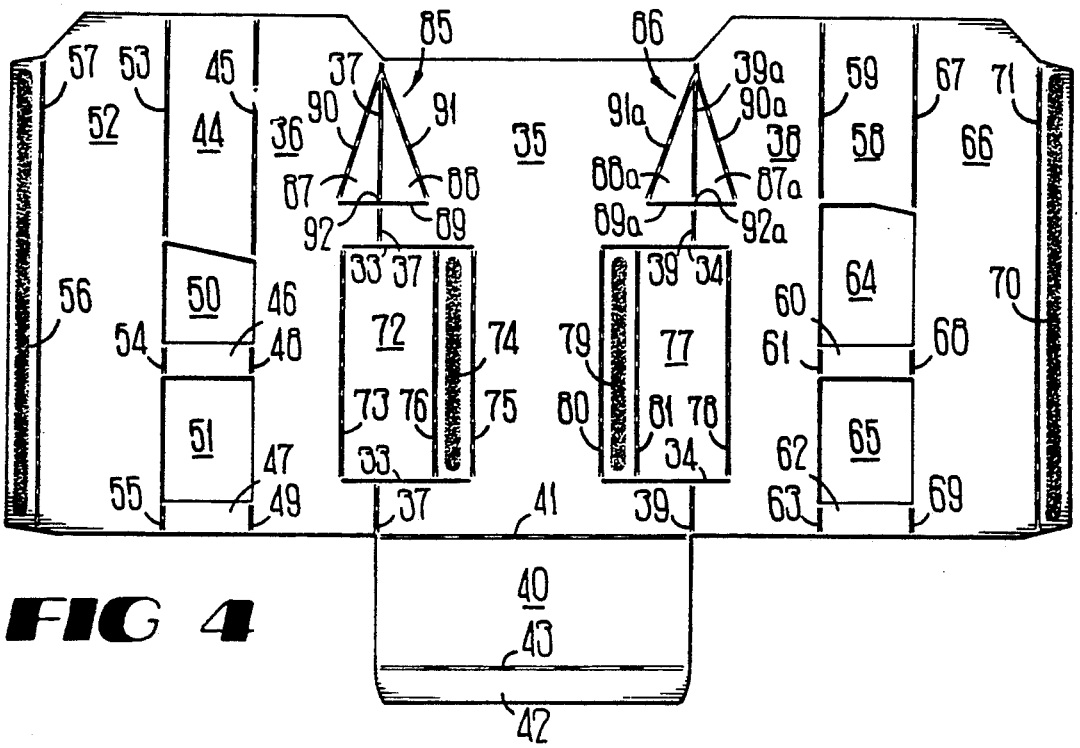
FIG. 4 is a plan view as viewed from the inner surface of the inner sleeve formed according to this invention.

At the other end of the blank of FIG. 4 complementary structure to that formed on the left hand side of the blank includes front panel 58 foldably joined to side wall 38 along fold line 59. Strip 60 is foldably joined to side wall 38 along fold line 61 and strip 62 is foldably joined to side wall 38 along fold line 63. Viewing windows 64 and 65 are formed in the front portion of the right hand compartment.

The inner side wall of the right hand compartment is designated by the numeral 66 and is foldably joined to panel 58 along fold line 67 and to strips 60 and 62 along fold lines 68 and 69 respectively. A glue flap 70 is foldably joined to panel 66 along a fold line 71.

Since the dimensions of the side compartments from front to rear are greater than the dimension of such compartments from side to side, a spacer panel 72 is struck from back wall 35 and side wall 36 along slits 33 and is foldably joined to side wall 36 along fold line 73. An anchoring panel 74 is also struck from back wall 35 along slits 33 and is foldably joined to the back wall along fold line 75 and to spacer panel 72 along fold line 76. In like fashion spacer panel 77 is struck from back wall 35 and side wall 38 along slits 34 and is foldably joined to side wall 38 along fold line 78 and anchoring panel 79 is struck from back wall 35 along slits 34 and foldably joined to the back wall along fold line 80 and to spacer panels 77 along fold line 81.

For the purpose of accommodating downward loading of objects into the compartments and for preventing upward movement of such objects after they are loaded, abutments generally designated at 85 and 86 are provided. Abutment 85 includes a right triangle 87 and a complementary right triangle 88. These right triangles are foldably joined to each other along the fold line 37. A cut line 89 severs the lower legs of triangles 87 and 88 from back wall 35 and side wall 36. Triangle 87 is foldably joined to side wall 36 along fold line 90 which constitutes the hypotenuse of right triangle 87. Similarly right triangle 88 is foldably joined to back wall 35 along fold line 91 which constitutes the hypotenuse of triangle 88. When side wall 36 is in its assembled position of normal relationship to the back wall 35, the end of fold line 37 which intersects the cut line 89 and which is identified by the numeral 92 projects into the compartment. The structure is yieldable when objects are loaded from above in a downward direction but such objects are prevented from upward movement due to engagement with the projection 92.

The abutment 86 is of identical construction to abutment 85 and the components of abutment 86 are identified with the same numerals as are used to identify abutment 85 with the suffix "a" added except the fold line 37 and 39 being different the corresponding component in abutment 86 is identified as 39*a*.

Figure 5:
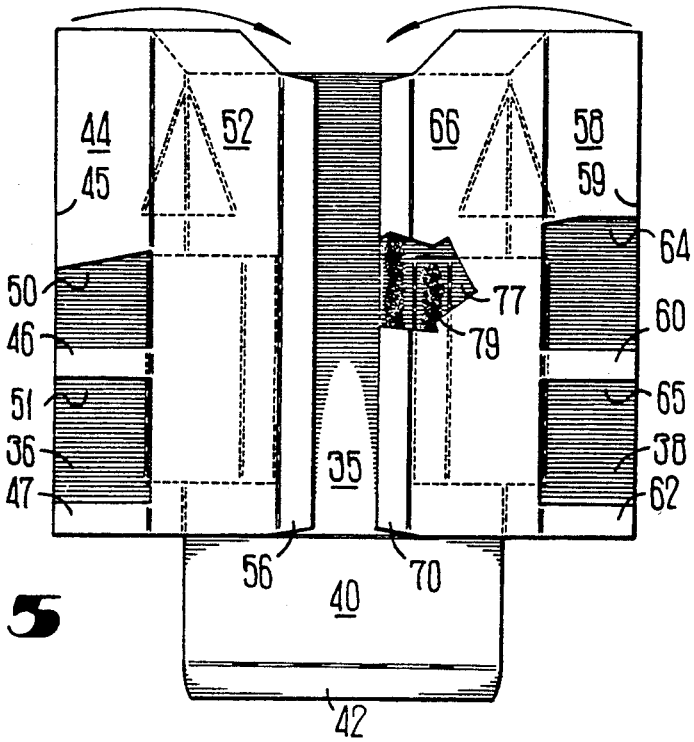
FIG. 5 is a view of the inner sleeve following its first folding operations and which shows the inner sleeve in collapsed condition.

In order to manipulate the blank as shown in FIG. 4 into the collapsed condition shown in FIG. 5, an application of glue is made to the glue flaps 56 and 70 as indicated by stippling in FIG. 4 and to the anchoring panels 74 and 79 as indicated by stippling in FIG. 4. Thereafter side wall 36 structures 44, 46, 47, 52, and 56 are elevated and folded to the right along fold line 45, 48 and 49. This operation causes the glue flap 56 to adhere to the back wall 35 and causes the anchoring panel to become adhered to the inner side wall 52 due to the flat face contacting relationship of these elements. Elements 58, 64, 65 along with inner side wall 66 and glue flap 70 are elevated and folded to the left along fold lines 59, 61 and 63. This operation causes the glue flap 70 to become adhered to the back wall 35 and also causes the anchoring panel 79 to become adhered to inner side wall 66.

Figure 7:
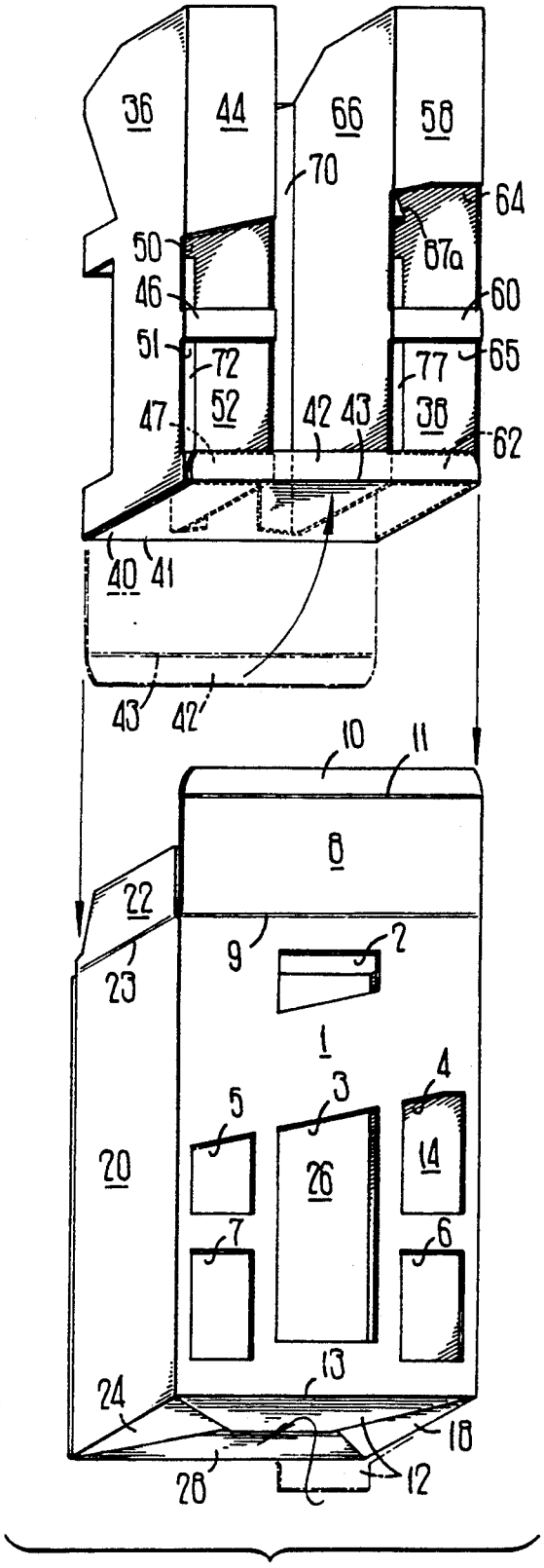

Manipulation of the collapsed blank as shown in FIG. 5 into set up condition is shown in the top portion of FIG. 7.

Figure 6A:
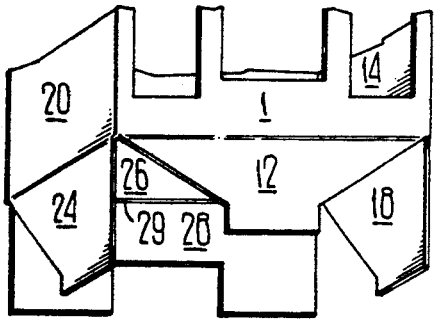
FIG. 6A is a perspective view of the bottom portion of the outer sleeve and which shows the bottom end closure flaps before folding operations begin.
Figure 6B:
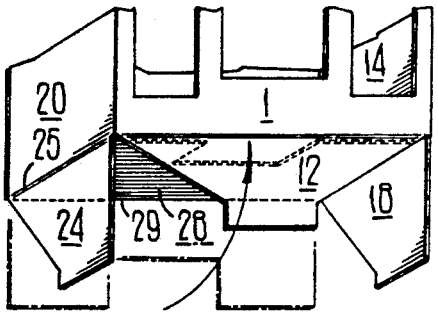
FIGS. 6B and 6C show sequential folding operations whereby the bottom closure flaps are manipulated toward closed condition and, FIG. 7 shows bottom closure flaps of the outer sleeve in fully closed condition and also shows the inner sleeve disposed immediately above the outer sleeve and arranged for telescopic downward movement of the inner sleeve into the outer sleeve. Such movement takes place following the closing movement of a bottom reinforcing panel foldably joined to the back bottom edge of the back wall of the inner sleeve.
Figure 6C:
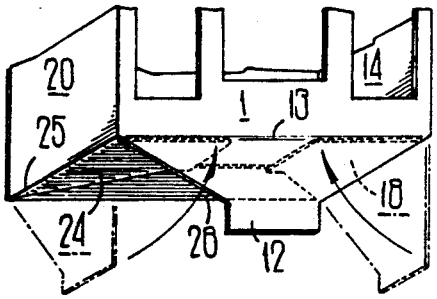

In order to reinforce the bottom structure of the case, reinforcing panel 40 is folded upwardly along its fold line 41 and the tucker flap 42 is folded into flat face contacting relation with the strips 47 and 62. Thereafter the inner sleeve is lowered into the outer sleeve shown at the lower portion of FIG. 7. Of course the bottom closure flaps 12, 18, 24 and 28 are manipulated into closed positions as shown in FIGS. 6A, 6B and 6C. Structure of FIGS. 6A, 6B and 6C is well known in the art. This structure together with the reinforcing panel 40 serves to provide a mechanically strong structure capable of supporting objects of considerable weight. The inner side walls 52 and 66 of the inner sleeve are spaced apart and define a medial cavity of square cross sectional configuration which conveniently serves to support an object such as a beverage bottle. Such a bottle is conveniently viewed through viewing windows 2 and 3.

Objects of different sizes are loaded into the compartments on either side, the front elements of which are identified by the numerals 44, 46, 47 and on the opposite side by the numerals 58, 60 and 62. Viewing windows 50, 51, 64 and 65 are formed in these side compartments and afford a clear and unobstructed view of the smaller objects which may be loaded into the case from above. As previously indicated, such smaller objects are lowered downwardly without resistance due to the abutment 85 and 86. Such objects when loaded are prevented from upward movement relative to the case due to engagement with the inwardly projecting points 92 and 92A of the abutments 85 and 86. Thus the package is adapted to hold the smaller objects in the side compartments against undesired jostling and also serves to position these objects at a proper level so as afford unobstructed view through the viewing windows 50, 51, 64 and 65.

Since the dimension from front to back of the side compartments is greater than the dimension from side to side, the spacer panels 72 and 77 are provided. As is apparent spacer panel 72 is foldably joined to side wall 36 along fold line 73 which is at a level forward of the back wall 35. Also the fold line 76 between the glue flap 74 is at the same level as fold line 73. Thus spacer panel 72 serves to provide a side compartment of desired quadrilateral cross section. In like manner the spacer panel 77 provides a structure which establishes a side compartment which is of square cross section According to this invention an unusually strong case is provided which is well suited for transporting and displaying at a point of purchase a group of dissimilar objects.

The case is especially adapted to afford a substantial measure of protection against pilfering. In this connection the double bottom of the outer sleeve as shown in FIG. 6A, 6B and 6C and which includes the reinforcing panel 40 insures substantial integrity for the bottom portion of the case. The top closure panel 8 is foldably joined to its tucking flap 10 along the fold line 11 which includes slots identified at 11*a* and 11*b* at its ends. These slots engage respectively the shoulder portions 22*a* of flap 22 and 16*b* of flap 16. Thus the top of the case is difficult if not impossible to open by a prospective pilferer Also the abutments 85 and 86 serve to hold the associated objects against upward dislodging movement and thus guard against pilfering.

I claim:

1. A case for packaging and displaying a plurality of dissimilar objects said case comprising an outer sleeve having front, back and side walls interconnected to form a tubular structure and including top and bottom closure elements, a first pair of object viewing windows formed in said front wall, an inner sleeve having back and side walls and arranged for telescopic insertion into said outer sleeve, a pair of spaced apart compartments formed within said inner sleeve and arranged respectively adjacent said side walls of said outer sleeve and defining a vertical medial cavity therebetween, the width of said compartments from side to side being somewhat less than the dimension of said compartments from front to rear, a spacer panel foldably joined along a first vertical fold line to each of said sidewalls, an anchoring panel secured in face contacting relation to the adjacent wall of said medial cavity and foldably joined to each of said spacer panels along a second vertical fold line which defines an edge of each of said spacer panels which is remote from each of said first vertical fold lines so as to afford a pair of compartments of desired quadrilateral horizontal cross section and of small horizontal dimensions than said medial cavity and a second pair of object viewing windows formed respectively in said compartments and arranged in general coincidence with said first pair of viewing windows.

2. A case for packaging and displaying a plurality of dissimilar objects said case comprising an outer sleeve having front, back and side walls interconnected to form a tubular structure and including top and bottom closure elements, a first pair of object viewing windows formed in said front wall, an inner sleeve having back and side walls and arranged for telescopic insertion into said outer sleeve, a pair of spaced apart compartments formed within said inner sleeve and arranged respectively adjacent said side walls of said outer sleeve and defining a vertical medial cavity therebetween, a second pair of object viewing windows formed respectively in said compartments and arranged in general coincidence with said first pair of viewing windows and an abutment struck from the back and side walls of said inner sleeve and disposed within each of said compartments, said abutments being yieldable to accommodate downward sliding loading of a displayed object and are positioned above and in firm abutting engagement with the associated object so as to secure such object against upward vertical movement.

3. A case according to claim 2 wherein each of said abutments comprises a pair of triangular shaped panels foldably joined to each other along corresponding sides and wherein one of said triangular shaped panels is struck from said back wall and the other of said triangular shaped panels is struck from one of said side walls.

4. A case according to claim 3 wherein said triangular shaped panels are in the shape of right triangles and are foldably joined respectively to said side and said back walls along fold lines which correspond with the hypotenuse of the associated right triangle.

5. A case according to claim 4 wherein each of said triangular panels is folded out of the plane of the associated back or side wall and into normal relation therewith when arranged to accommodate downward loading movement of an object and to secure such object against upward movement.

6. A case for packaging and displaying a plurality of dissimilar objects said case comprising an outer sleeve having front, back and side walls interconnected to form a tubular structure and including top and bottom closure elements, a first pair of object viewing windows formed in said front wall, an inner sleeve having back and side walls and arranged for telescopic insertion into said outer sleeve, a pair of spaced apart compartments formed within said inner sleeve and arranged respectively adjacent said side walls of said outer sleeve and defining a vertical medial cavity therebetween, a second pair of object viewing windows formed respectively in said compartments and arranged in general coincidence with said first pair of viewing windows and a reinforcing bottom panel foldably joined to said back wall of said inner sleeve along the bottom edge thereof and a tucking flap foldably joined to said bottom panel along the front edge thereof and interposed between said front wall of said outer sleeve and said compartments.

7. A case according to claim 6 wherein a plurality of closure flaps are foldably joined to the bottom edges of said outer sleeve and secured in flat face contacting relation with said reinforcing bottom panel.

8. A case for packaging and displaying a plurality of dissimilar objects said case comprising an outer sleeve having front, back and side walls interconnected to form a tubular structure and including top and bottom closure elements, an inner sleeve having back and side walls and arranged for telescopic insertion into said outer sleeve, at least one compartment formed within said inner sleeve and arranged adjacent one of said side walls of said outer sleeve and defining a vertical cavity adjacent thereto, an abutment struck from the back and one side wall of said inner sleeve and disposed within said compartment, said abutment being yieldable to accommodate downward sliding loading of a displayed object and which is positioned above and in firm abutting engagement with the associated object so as to secure such object against upward vertical movement.

9. A case according to claim 8 wherein said abutment comprises a pair of triangular shaped panels foldably joined to each other along corresponding sides and wherein one of said triangular shaped panels is struck from said back wall and the other of said triangular shaped panels is struck from said one side wall.

10. A case according to claim 9 wherein said triangular shaped panels are in the shape of right triangles and are foldably joined respectively to said side and said back walls along fold lines which correspond with the hypotenuse of the associated right triangle.

11. A case according to claim 10 wherein each of said triangular panels is folded out of the plane of the associated back or side wall and into normal relation therewith when arranged to accommodate downward loading movement of an object and to secure such object against upward movement.

* * * * *